United States Patent [19]

Bell

[11] Patent Number: 4,951,579

[45] **Date of Patent: * Aug. 28, 1990**

[54] LOW NOX COMBUSTION PROCESS

[75] Inventor: Ronald D. Bell, Austin, Tex.

[73] Assignee: Radian Corporation, Austin, Tex.

[ * ] Notice: The portion of the term of this patent subsequent to Mar. 14, 2006 has been disclaimed.

[21] Appl. No.: 318,893

[22] Filed: Mar. 3, 1989

Related U.S. Application Data

[63] Continuation-in-part of Ser. No. 122,067, Nov. 18, 1987, Pat. No. 4,811,555, and a continuation-in-part of Ser. No. 252,681, Oct. 3, 1988.

[51] Int. Cl.[5] ..... F23B 5/00

[52] U.S. Cl. ..... 110/212; 110/213; 110/214; 60/39.06

[58] Field of Search ..... 110/345, 210–214; 432/72

[56] References Cited

U.S. PATENT DOCUMENTS

| | | | |
|---|---|---|---|
| 3,472,498 | 10/1969 | Price et al. | 110/212 |
| 3,780,674 | 12/1973 | Liu | 110/212 |
| 3,996,862 | 12/1976 | Besik et al. | 110/212 |
| 4,013,023 | 3/1977 | Lombana et al. | 110/212 |
| 4,038,032 | 7/1977 | Brewer et al. | 110/212 |
| 4,213,403 | 7/1980 | Gomori | 110/214 |
| 4,458,662 | 7/1984 | Barnett | 110/214 |
| 4,475,472 | 10/1984 | Adrian et al. | 110/214 |
| 4,483,258 | 11/1984 | John et al. | 110/213 |
| 4,784,069 | 1/1988 | Stark | 110/212 |
| 4,811,555 | 3/1989 | Bell | 60/39.06 |

*Primary Examiner*—Henry C. Yuen

*Attorney, Agent, or Firm*—Klauber & Jackson

[57] ABSTRACT

A process for low NOX combustion which involves combusting an oxygen-containing combustible gas stream having fuel material in excess of the oxygen in the combustible gas stream, whereby the combustible gas stream is combusted in a reducing atmosphere to produce a heated oxygen-depleted gaseous stream, converting at least a portion of the heat in the oxygen-depleted depleted stream into steam, adding air to the oxygen-depleted stream to produce a stoichiometric excess of oxygen in the resultant stream relative to fuel material present in the resultant stream, passing the resultant stream over the oxidizing catalyst to produce an oxidized gaseous stream, optionally removing heat from the oxidized stream, and venting the resultant cooled stream. A system for carrying out the foregoing process is also provided.

10 Claims, 1 Drawing Sheet

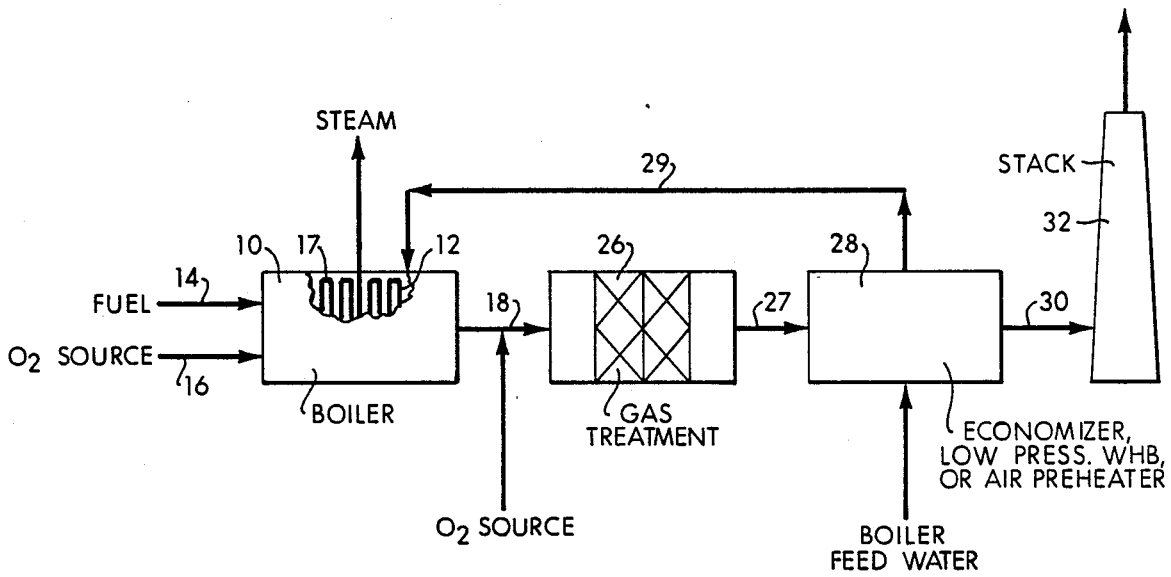
STEAM
29
STACK
32
10
17
12
26
28
14
FUEL
18
27
30
$O_2$ SOURCE
16
BOILER
GAS TREATMENT
ECONOMIZER, LOW PRESS. WHB, OR AIR PREHEATER
$O_2$ SOURCE
BOILER FEED WATER

LOW NOX COMBUSTION PROCESS

REFERENCE TO RELATED APPLICATION

This is a Continuation-in-Part of application Ser. No. 122,067 filed Nov. 18, 1987, U.S. Pat. No. 4,811,555 and of application Ser. No. 252,681 filed Oct. 3, 1988.

FIELD OF THE INVENTION

This invention relates to ensuring low NOX content of products of combustion and is more particularly concerned with combustion in a fired steam-generating boiler which ensures low NOX content of the evolved gases.

BACKGROUND OF THE INVENTION

Many combustion processes generate effluent gases having an unacceptable NOX content. Thus, oxides of nitrogen are one of the principal contaminants emitted by combustion processes. These compounds are found in stack gases mainly as nitric oxide (NO) with lesser amounts of nitrogen dioxide ($NO_2$) and only traces of other oxides. Since nitric oxide (NO) continues to oxidize to nitrogen dioxide ($NO_2$) in the air at ordinary temperatures, there is no way to predict with accuracy the amounts of each separately in vented gases at a given time. Thus, the total amount of nitric oxide (NO) plus nitrogen dioxide ($NO_2$) in a sample is determined and referred to as "oxides of nitrogen (NOX)".

Oxides of nitrogen emissions from stack gases, through atmospheric reactions, produce "smog" that stings eyes and causes acid rains. For these reasons, the content of oxides of nitrogen present in gases vented to the atmosphere is severely limited by various state and federal agencies. To meet the regulations for NOX emissions, several methods of NOX control have been employed. These can be classified as either equipment modification or injection methods. Injection methods include injection of either water or steam to lower the temperature since the amount of NOX formed generally increases with increasing temperatures, or injection of ammonia to selectively reduce NOX. Water or steam injection, however, adversely affects the overall fuel efficiency of the process.

A process involving the injection of ammonia into the products of combustion is shown, for example, in Welty, U.S. Pat. No. 4,164,546. Examples of processes utilizing ammonia injection and a reducing catalyst are disclosed in Sakari et al, U.S. Pat. No. 4,106,286; and Haeflich, U.S. Pat. No. 4,572,110. Selective reduction methods using ammonia injection are expensive and somewhat difficult to control. Thus, these methods have the inherent problem of requiring that the ammonia injection be carefully controlled so as not to inject too much and create a possible emission problem by emitting excess levels of ammonia. In addition the temperature necessary for the reduction of the oxides of nitrogen must be carefully controlled to get the required reaction rates.

Equipment modifications include modifications to the burner or firebox to reduce the formation of NOX. Although these methods do reduce the level of NOX, each has its own drawbacks. A selective catalytic reduction system is presently considered by some authorities to be the best available control technology for the reduction of NOX. Currently available selective catalytic reduction systems used for the reduction of NOX employ ammonia injection into the exhaust gas stream for reaction with the NOX in the presence of a catalyst to produce nitrogen and water vapor. Such systems typically have an efficiency of 80–90 percent when the gas stream is at temperature within a temperature range of approximately 600°–700° F. The NOX reduction efficiency of the system will be significantly less if the temperature is outside the stated temperature range and the catalyst may be damaged at higher temperatures. As the present inventor R. D. Bell has disclosed in McGill et al U.S. Pat. No. 4,405,587, of which he is a co-patentee, oxides of nitrogen can be reduced by reaction in a reducing atmosphere such as disclosed in that patent at temperatures in excess of 2000° F.

An important source of NOX emissions is found in the field of steam generation in direct-fired boilers. Excessive NOX emissions from such combustion are a serious environmental problem and various efforts to suppress them, such as the techniques referred to above, have been attempted, with varying results.

It is, accordingly, an object of this invention to provide an improved method involving combustion which brings about effective lowering of NOX in the combustion emissions and subsequent treatment to produce an acceptable final emission.

It is another object of the invention to provide a system for combustion in fired steam-generating boilers wherein final emissions will have significantly lowered NOX levels and be environmentally acceptable.

BRIEF SUMMARY OF THE INVENTION

In accordance with the invention, in a process involving combustion which normally produces unacceptable NOX emissions, more particularly combustion in a fired steam-generating boiler, there is provided a fuel-rich combustion which proceeds under reducing gaseous conditions and provides an oxygen-deficient gaseous effluent. The gases produced by the combustion in the boiler are used to generate steam in the boiler and the effluent is further treated. More particularly, air is added to the gaseous effluent to form a lean fuel-air mixture, and this mixture is passed over an oxidizing catalyst, with the resultant gas stream, meeting NOX emission standards, and being environmentally acceptable, thereafter vented to the atmosphere. Preferably, for optimum heat recovery, the gas stream, after passing over the oxidizing catalyst and before it is vented, is passed to an economizer or low pressure waste heat boiler or other heat exchanger. The apparatus system of the invention particularly suited for carrying out the above-described process for low NOX involving a fired steam-generating boiler, comprises means defining a combustion zone; means for adding fuel and oxygen-containing fluid to the combustion zone to produce a reducing atmosphere therein; means for converting to steam at least a portion of the heat in the combusion zone; means for adding air to the effluent from the boiler; an oxidizing catalyst-containing reaction chamber to receive the air-enriched effluent; and a vent for removal of the final effluent. Optionally, heat recovery means for removing heat from the effluent from the reaction chamber are also provided.

BRIEF DESCRIPTION OF THE DRAWING

The FIGURE of the drawing is a diagrammatic flow sheet of a fired steam-generating boiler system embodying features of the present invention.

DETAILED DESCRIPTION OF THE PREFERRED EMBODIMENTS

Referring now to the FIGURE of the drawing, there is shown an illustrative embodiment of the invention. In the drawing, the reference numeral 10 designates a fired steam-generating boiler or boiling chamber comprising a combustion chamber or zone 12. Fuel, e.g. gas, such as natural gas, is supplied through line 14, and combustion air is supplied through line 16. Combustion takes place in the combustion chamber or zone 12. Into the combustion zone 12, fuel and air are added in amounts such that fuel is in stoichiometric excess with respect to available oxygen, e.g., 10 to 25% excess, and combustion takes place in the combustion zone 12 under reducing conditions, generally at about 2200° to 2600° F. A residence time of about 0.5 second is required. A greater residence time can be employed, but serves no useful purpose. It is to be understood that the term "air" is to be interpreted as any source of oxygen. It may actually be air or it may be in the form of pure oxygen or of any desired diluted oxygen mixture. The boiler has tubes 17 or other steam-generating surfaces so that steam is generated from the hot gases resulting from the combustion, thereby cooling the gases, which leave the boiler or boiling chamber 10 at a temperature of about 400° to 550° F., typically about 500° F. At this point, the effluent gas stream is still oxygen deficient in terms of the stoichiometric relationship between its content of oxygen and combustible material, e.g., fuel. Thereupon, it is passed into conduit 18.

The gas is, however, low in NOX and the treatment of the gases flowing through the system has brought about a reduction of any NOX formed, or a suppression of the formation of the NOX, without the use of ammonia or like treatment widely used in the prior art. In order, however, to utilize to the maximum the heat potential of the gas and any fuel which it may contain, air is added to the stream in conduit 18 and the resulting gaseous stream is passed to a gas-treatment unit 26 wherein the gas stream is passed over an oxidizing catalyst. The air is added in an amount relative to the stream in conduit 18 such that the resulting stream will contain oxygen stoichiometrically in excess of the amount needed to burn any fuel in the stream, e.g., 10% to 50% excess. Thus, products at approximately the boiler discharge temperature, e.g., 500° F. are mixed with air or other oxygen source and passed over an oxidizing catalyst.

Either noble metal oxidizing catalysts such as platinum or palladium, or base metal oxides, such as copper oxide, chrome oxide, or manganese oxide, or the like, may be used for this purpose. The noble metal oxidizing catalysts, e.g., platinum or palladium catalysts, are most suitably the noble metals deposited in the zero valent state upon a support, such as alumina, silica, kiesel-guhr, or a metal alloy, and the like. The metal oxide catalysts are also most suitably the metal oxides supported on supports of this character. The making of such catalysts is well known to persons skilled in the art. Catalyst volumes will vary depending on the particular catalyst used. Ordinarily, the quantity of catalyst and the flow rate are such that the space velocity is typically in the range of 30,000 to 50,000 $hr.^{-1}$.

Data indicate that NOX levels in the parts per billion range can be realized by the combined reduction-oxidation operations of this invention. The oxidized gaseous effluent from the unit 26 preferably passes into a conduit 27 which leads to an economizer or a low-pressure, waste heat boiler, heat-exchanger, or the like, indicated at 28, or water, steam or other inert fluid is directly added to it, and the heat content of the oxidized gaseous effluent is extracted to the maximum amount economically feasible. As seen in the drawing, advantageously, the boiler feed water is first passed in indirect heat-exchange relationship through economizer 28, and is heated by heat exchange with the gas and is passed via line 29 to boiler 12. The cooled gas at a temperature of about 300° to 400° F. is then discharged through an outlet conduit 30 into a stack 32 and vented to the atmosphere with the assurance that the vented effluent will comply with NOX emission standards. It will have a NOX content of less than 50 ppm. If desired, the cooling step can be omitted and the effluent from gas-treatment unit 26 can be passed directly to stack 32.

It will, of course, be understood that in the foregoing description of the drawing, reference to a boiler, waste-heat boiler, economizer, gas treatment unit, and the like, contemplates the use of standard equipment well known to persons skilled in the art. The gas treatment unit, for example, can be any container adapted for gas passage and containing an oxidizing catalyst. In particular, the boiler has conventional steam-generating surfaces, e.g. tubes.

Minimizing the formation of oxides of nitrogen in combustion, in accordance with the invention, offers several advantages over the current state of the art. This process does not require that a potentially obnoxious gas, such as ammonia, be injected into the system; the reaction conditions do not require that a narrowly-controlled temperature be maintained for the reduction of oxides of nitrogen to occur; the operating conditions are compatible with conventional boiler conditions; and greater NOX reduction efficiencies can be achieved.

The following example will serve more fully to illustrate the features of the invention.

In a typical operation, the combustion zone of a boiler is fed with fuel, and an oxygen source, e.g. air, to produce a combustible mixture which has a fuel content such that the fuel content is 10% in stoichiometric excess relative to the oxygen present. The resultant stream is then combusted in the boiler combustion zone at a temperature of about 2000° -2400° F. and, since the combustible material is in excess, the combustion takes place in a reducing atmosphere. Heat present in the combustion products is at least partially converted into steam by heat exchange with water, e.g., in boiler tubes, and the resulting gaseous stream, which is of course, oxygen depleted, has a temperature of about 500° F. To this oxygen-depleted stream is then added air or other oxygen-containing gas at ambient temperature to the stream in an amount such that the resultant stream has an oxygen content which is 10–50% stoichiometrically in excess relative to any fuel present in the oxygen-depleted stream to which the oxygen source is added. The resultant oxygen-rich stream is then fed through a bed containing a noble metal, e.g., platinum or palladium, supported on alumina, with a space velocity of 30,000–50,000 $hr.^{-1}$. At this point the gaseous stream being processed has a temperature of about 450° F. This temperature increases across the catalyst bed to about 800° F. Heat is then extracted by appropriate heat exchange to leave a final stream to be vented having a temperature of about 400° F. and a NOX content of less than 50 ppm.

It will be understood that various changes and modifications may be made without departing from the invention as defined in the appended claims and it is intended, therefore, that all matter contained in the foregoing description and in the drawing shall be interpreted as illustrative only and not in a limiting sense.

I claim:

1. A process for low NOX steam-generating combustion which comprises combusting in a combustion zone at temperatures of at least 2000° F., a mixture of fuel and an oxygen source, wherein said mixture contains fuel in stoichiometric excess of the oxygen in said mixture, whereby said combustion takes place in a reducing atmosphere and produces heated oxygen-depleted gases, converting at least a portion of the heat in said oxygen-depleted gases into steam, thereby cooling said gases; forming said cooled oxygen-depleted gases into an effluent stream and adding air to said effluent stream to produce a stoichiometric excess of oxygen in the resultant stream relative to fuel present in said resultant stream, passing said resultant stream over an oxidizing catalyst to produce an oxidized gaseous stream, and passing the said oxidized stream on for venting.

2. A process as defined in claim 1, wherein heat is removed from said oxidized gaseous stream.

3. A process as defined in claim 1, wherein said mixture is combusted in said combustion zone at a temperature of 2200° to 2600° F.

4. A process as defined in claim 1, wherein said mixture combusted in said combustion zone has a residence time of at least about 0.5 second.

5. A process as defined in claim 1, wherein said oxygen-depleted stream is cooled to a temperature of about 500° F. during said conversion to steam.

6. A process as defined in claim 1, wherein the space velocity of said resultant stream passing over said oxidizing catalyst is about 30,000 to 50,000 $hr.^{-1}$.

7. A process as defined in claim 1, wherein said air is added to said oxygen-depleted stream in an amount to provide a stoichiometric excess of oxygen present in the resultant stream of 10 to 50%.

8. A process as defined in claim 2, wherein the cooled gas vented to the atmosphere is at a temperature of about 300° to 400° F.

9. A process as defined in claim 1, wherein the gas vented to the atmosphere has a NOX content of less than 50 ppm.

10. A process in accordance with claim 1, wherein the temperatures in said combustion zone are in the range of 2200° to 2600° F. and said cooled effluent is in the range of from 400° to 550 ° F.

* * * * *